United States Patent [19]

Kuckhermann

[11] 4,084,761

[45] Apr. 18, 1978

[54] ROLL SUPPORT ASSEMBLY

[76] Inventor: Gustav Kuckhermann, Fautenbacher Strasse 24, Achern, Germany

[21] Appl. No.: 696,829

[22] Filed: Jun. 16, 1976

[30] Foreign Application Priority Data

Jun. 16, 1975 Germany ..... 2526962

[51] Int. Cl.[2] ..... B65H 19/12; B65H 17/12

[52] U.S. Cl. ..... 242/58.6; 242/68.7

[58] Field of Search ..... 242/58, 58.1–58.6, 242/68.7, 78.7, 67.3, 55, 78.6

[56] References Cited

U.S. PATENT DOCUMENTS

| | | | |
|---|---|---|---|
| 2,220,230 | 11/1940 | Gilbert | 242/68.7 |
| 2,389,443 | 11/1945 | Lyle | 242/58.6 X |
| 3,343,760 | 9/1967 | Haskin et al. | 242/58.6 |
| 3,643,885 | 2/1972 | Keesling | 242/78.7 |

FOREIGN PATENT DOCUMENTS

| | | | |
|---|---|---|---|
| 387,516 | 5/1965 | Switzerland | 242/58.1 |

*Primary Examiner*—Harvey C. Hornsby
*Assistant Examiner*—John M. Jillions
*Attorney, Agent, or Firm*—Holman & Stern

[57] ABSTRACT

A roll support assembly for supporting separate supply rolls carrying webs which are to be joined to one another to provide a continuous web supply. The support assembly includes a main support onto which each new supply roll is loaded and in which the roll is supported at its axial ends. The assembly includes an auxiliary support to which a partly expired roll may be transferred to enable a further supply roll to be loaded on to the main support. The auxiliary support incorporates rollers engaging the peripheral surface of the partly expired roll and is mounted movably with respect to the main support such that a partly expired roll may be simultaneously supported by both the main and the auxiliary support.

8 Claims, 5 Drawing Figures

1
2
3
4
5
6
7
8
9
12
13
15
16
17
18
19
20
25
26
27
28
29
30
31
A

ROLL SUPPORT ASSEMBLY

BACKGROUND OF THE INVENTION

The present invention relates to a roll support assembly for supporting webs wound in separate supply rolls and the ends of which are to be joined to produce a continuous web.

Such roll support assemblies are used for example in connection with so-called tube-making machines in a plant for producing paper sacks. They are to render possible an uninterrupted supply of paper webs to the tube-making machine and they serve for setting into motion a replacement roll while another expiring roll still delivers roll material. As a rule, the unwound web is drawn off by draft rollers and draft rolls in the tube-making machine. The forward end of the roll material running off the replacement roll can be attached to the expiring material of the nearly unwound roll in such a roll support assembly during operation. In the case of paper webs, the joining is effected preferably by adhesives. After the joining of the material of various rolls, the still projecting trailing end of the nearly unwound roll can be severed by means of cutter blades and corresponding rollers so that roll material leaves the roll support assembly without interruption and is of uniform thickness except for the area of attachment from roll to roll.

In particular in the paper manipulating industry, such as for example in the manufacture of paper sacks, the supply rolls have a very great weight and present particular problems not only for that reason but also because of the sensitivity of paper webs in particular in respect of re-positioning a roll from a main support to an auxiliary support. Such re-positioning of the expiring roll from a main support to an auxiliary support is to free the main support for receiving a fresh supply roll and is necessary in particular for the production of endless webs.

SUMMARY OF THE INVENTION

In accordance with the present invention, there is provided a roll support assembly for supporting webs wound in separate supply rolls and the ends of which are to be joined to produce a continuous web, comprising a main support for supporting each newly loaded supply roll and an auxiliary support to which each supply roll may be transferred when partly expired to enable a further supply roll to be loaded on the main support, wherein in the main support, the supply roll is supported at its axial ends and in the auxiliary support the supply roll is supported by means of at least one group of rollers operative to engage the peripheral surface of the supply roll and mounted in such a manner as to be movable by mutually equal amounts towards and away from the axis of the supply roll, the main and auxiliary supports being movable relative to one another such that a partly expired roll may be simultaneously supported by both supports.

A roll may be supported in practice in one of two possible ways, namely it can be supported at its axial ends or by rollers engaging its periphery. The invention relies on a change from one form of support to the other when transferring a supply roll from the main support to the auxiliary support. The auxiliary support engages the periphery since in operation the auxiliary support receives a partly unwound roll which is therefore lighter.

Some of the preferred features of the invention fulfill the condition that the geometrical roll axis of the auxiliary support is fixed independently of the spacing of any of the rollers from its axis. It is advantageous to group together four or another even number of support rollers in an axially symmetrical group but alternatively three or any odd number of support rollers may be grouped together provided that they fulfill the condition of being commonly movable with equal spacing from the imaginary rolling axis for a supported supply roll.

The position of the rolling axis fixed by equidistance from the support rollers of the auxiliary support relative to the axis of a supply roll in the main support is thus determined merely by the entire position of the auxiliary support relative to the main support. The auxiliary support can be used, on a suitable displacement track and slides, or carriages, for displacing the auxiliary support relative to the main support, for engagement with the same roll which is held also by the main support, the roll axes of the two supports coinciding coaxially. Under the circumstances, no positional displacement of any kind occurs at the expiring roll, it being immaterial whether its weight then rests on the main support or on the auxiliary support, provided the support rollers of the auxiliary support lie on the periphery of the roll.

For accelerating the rotation of a new supply roll, a drive mechanism may be provided on the main support and may preferably comprise a driving roller which is designed to engage an end face of the roll. Such a driving roller may be connected by means of a belt or chain drive or by means of a transmission shaft to a drive motor which is also in connection with draft rollers or draft rolls for drawing the roll material off the roll in such a manner that the peripheral speed of the driving roller agrees approximately with the drafting speed of the expiring roll material, or is at least synchronized therewith. Preferably the driving roller will be mounted by way of a shaft on a pneumatic pivoting and pressing mechanism which in turn is attached to one of the support arms or members of the main support. Upon insertion of a replacement roll into the main support, the driving roller can thus be pivoted and pneumatically, i.e. resiliently yieldingly pressed against one of the end faces of the roll.

BRIEF DESCRIPTION OF THE DRAWINGS

The invention will now be described further, by way of example, with reference to the accompanying drawings, in which.

Similar component parts of the constructional example are denoted in all figures by the same reference numerals.

DETAILED DESCRIPTION OF THE PREFERRED EMBODIMENT

Figure 1:
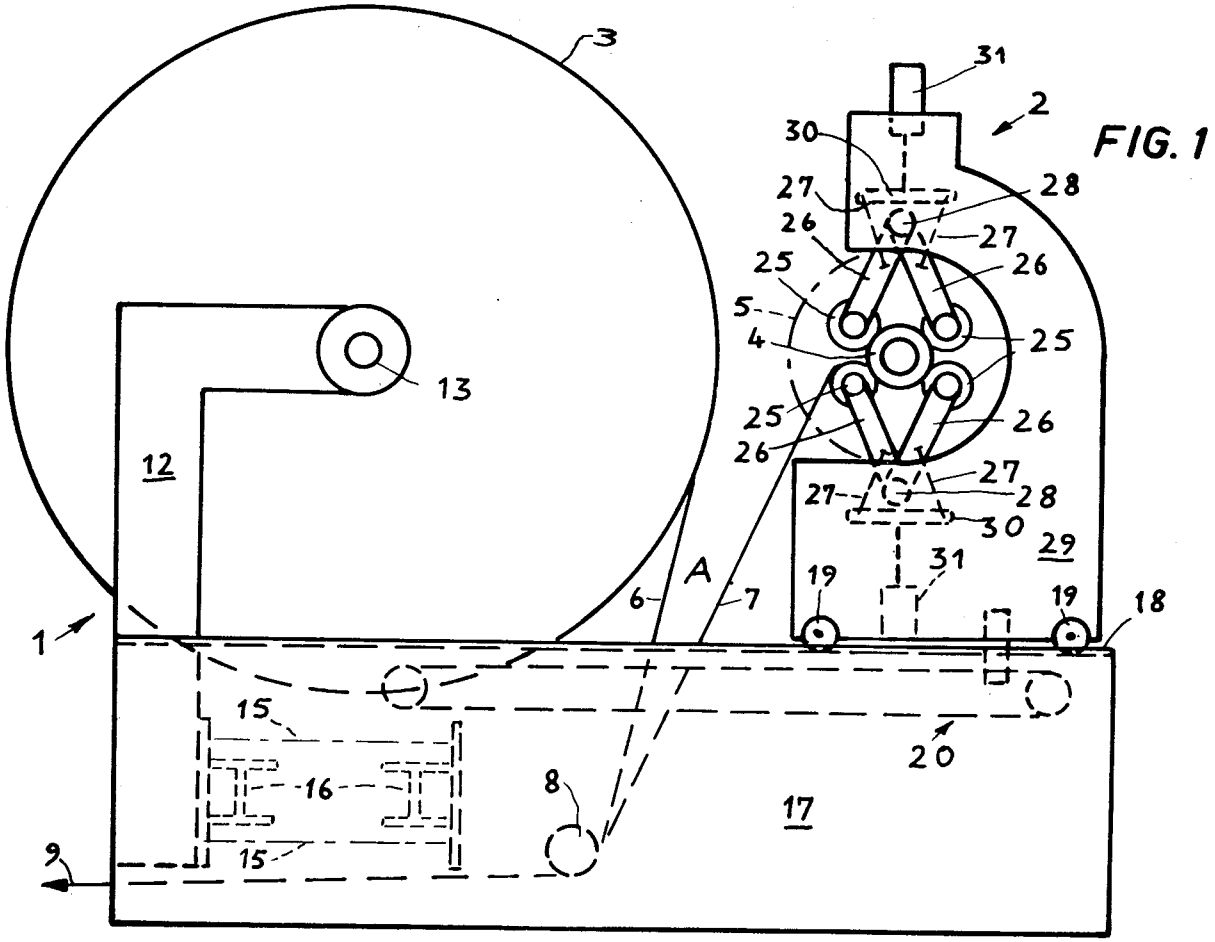
FIG. 1 is a diagrammatic side view of a roll support assembly according to the invention with a main support which supports a replacement roll, and with an auxiliary support on which a nearly expired roll is located.
Figure 2:
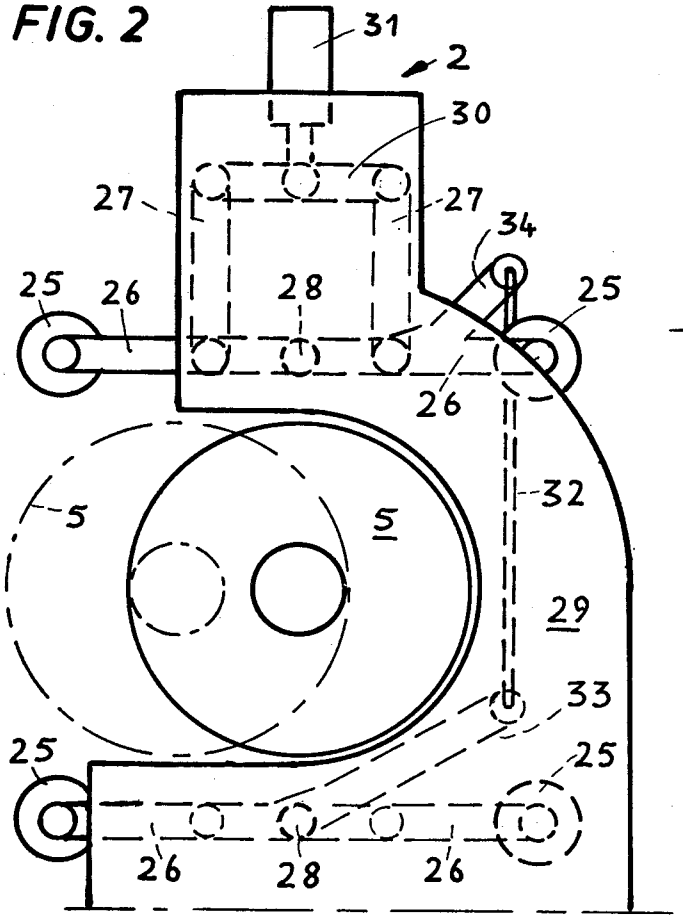
FIG. 2 is a diagrammatically shown section of the auxiliary support according to FIG. 1 in a different operational position.
Figure 5:
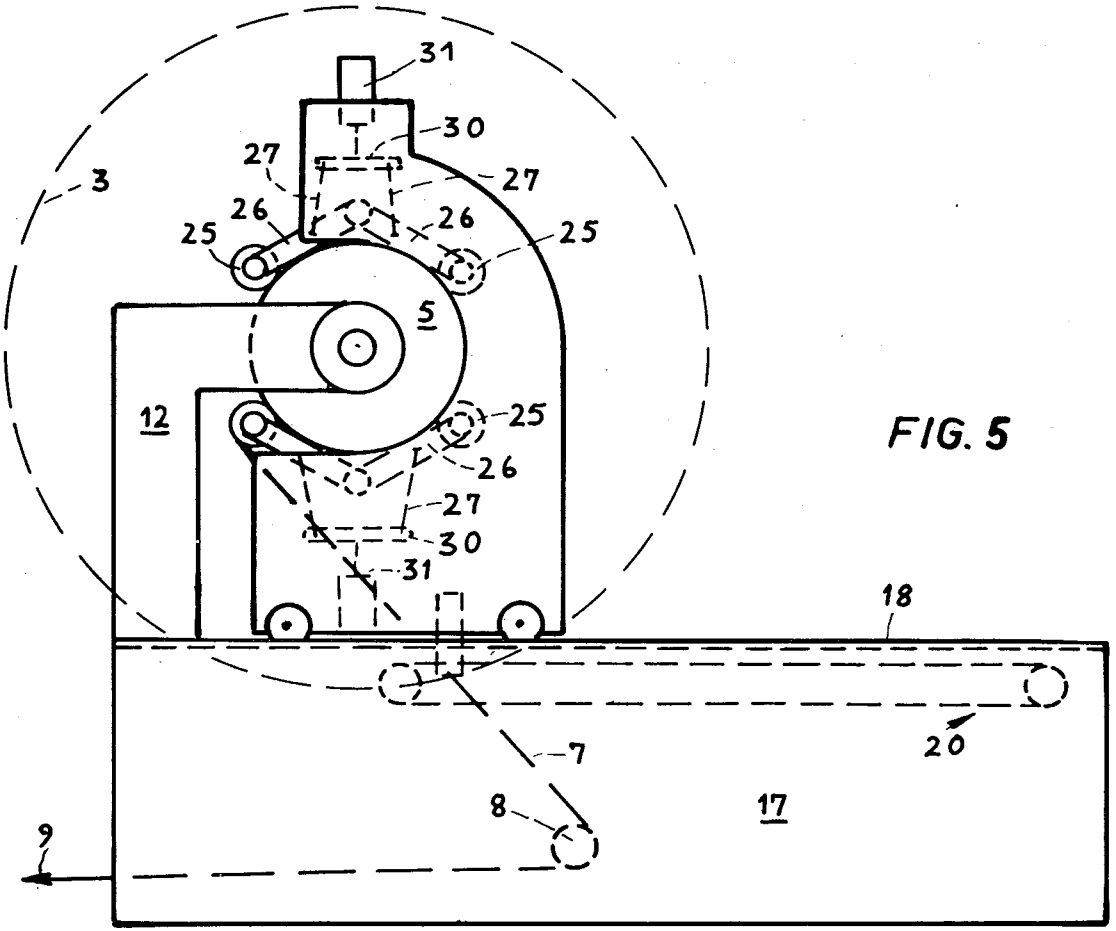
FIG. 5 is a diagrammatically shown side view of the roll supporting according to FIG. 1, during transfer of a partly expired roll from the main support to the auxiliary support.

The roll support assembly according to FIG. 1 comprises a main support 1 and an auxiliary support 2. An at least approximately complete replacement roll 3 is disposed on the main support and a nearly expired roll 4 on the auxiliary support. The transfer of the roll 4 from the main support to the auxiliary support had been accomplished in a preceding operational step. During this operational step the roll had the magnitude indicated by a dash-dotted line 5. In FIGS. 2 and 5 which show the transfer, a roll of this magnitude is designated 5 and will be referred to as an interchange roll.

Let it be assumed that in the given example the rolls are paper rolls. A paper web 6 off the replacement roll 3 and a paper web 7 off the roll 4 are drawn over a common guide roller 8 out of the roll support assembly in the direction of arrow 9. In the region of the roll support assembly marked by the capital letter A there may be located gumming mechanisms or other adhesion effecting mechanisms, presser rollers extending parallel to the roll axis of the auxiliary support and cutter devices of constructional form known per se, which effect adhesion of the two paper webs 6 and 7 one to the other along a transverse line and permit the trailing end of the paper web 7 to be cut off.

Figure 4:
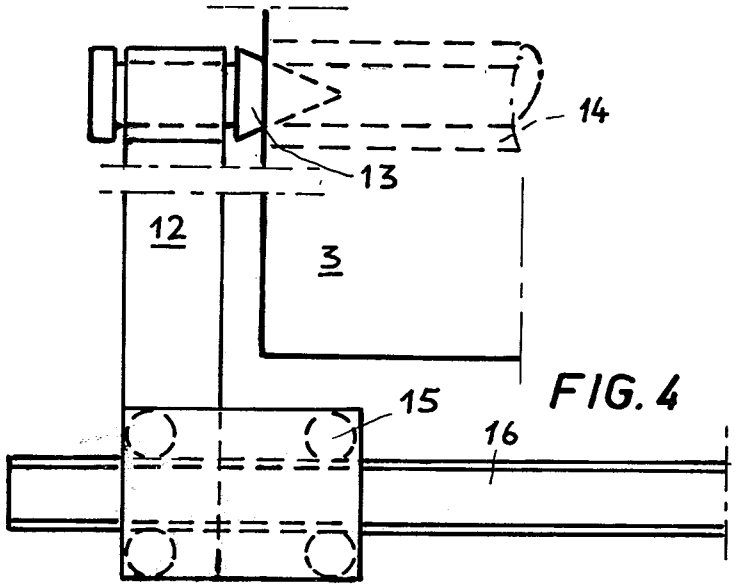
FIG. 4 is a diagrammatically shown view of the rear of a support beam with mandrel of the main support according to FIG. 1.

The main support 1 comprises a support arm 12 on each of the two end faces of the roll 3. One each of the support arms there is located a mandrel 13 which, as shown in FIG. 4, engages in a sleeve 14 on which the roll 3 is wound. The sleeve, the mandrels at the two ends of the sleeve and the whole roll are able to form a substitute for a separate support shaft. However, in the case of insufficient carrying capacity it may be advantageous to guide a support shaft instead of the mandrels through the whole sleeve.

As shown in FIGS. 1 and 4, each support arm 12 is fixed to a carriage 15 which rolls on a rail track 16 extending approximately parallel to the axis of the roll 3. Thus the support arms can be guided on this rail track to the two end faces of the replacement roll to such extent that the mandrels are securely located in the ends of the sleeve 14. If the replacement roll was previously suspended from a hoist, it may be released therefrom as soon as the support arms are fixed in the last mentioned position. As soon as the roll has attained in the course of operation the size of an interchange roll 5, it can be received by the auxiliary support 2. For the transfer the roll can be released simply by moving the support arms 12 apart on the rail track 16 until the mandrels 13 have left the ends of the sleeve 14. If, in place of the mandrels 13, a support axis extending completely through the sleeve 14 was present, the interchange of the rolls would require much more time, work and expenditure for the apparatus.

As seen in FIGS. 1 and 5, a base frame 17 connects the main support 1 to the auxiliary support 2. Carriage wheels 19 of the auxiliary support engage in approximately rectilinear tracks 18 in such a manner that the auxiliary support can be displaced relative to the main support 1 relatively easily on the base frame. For the displacement there is provided a traction device 20 of a construction known per se with an endless cable or chain loop passing over pulleys or sprockets and connected by a driver member to the auxiliary support.

The auxiliary support 2 comprises at least one group of four support rollers 25 which are designed to lie against the surface of the roll 4 or 5 with roller axes which are parallel to each other and to the axis of the roll. Each of the support rollers 25 is rotatably mounted on a free end of a support beam 26 the center region of which is pivotally engaged by a control arm 27. The ends of the support beams 26 remote from the rollers are pivotably secured to a support frame 29 and are pivotable about a common axis defined by a bearing 28. These two support beams 26 are pivotally connected to a common control slider 30 by means of the control arms engaging their center regions. A hydraulic or pneumatic drive motor 31 engages each control slider. Each control slider is also mounted on the support frame in a rectilinearly movable manner.

The two support rollers 25, support beams 26, control arms 27 and common control slider 30 together with the support frame 29 and the bearing 28 form a scissors-like support for a roll. In fact such a scissors-like support with only two rollers would be sufficient for receiving an interchange roll 5. The mutually coupled parts of the support form a control drive which ensures equidistance of the two support rollers from an imaginary geometrical roll axis within the auxiliary support 2. However, upon transfer of an interchange roll 5 to a single scissors-like support the drive motor 31 connected thereto must be matched very carefully to the diameter and the weight of the roll, if the interchange roll is to lie co-axially to the imaginary geometrical roll axis and must not be lowered or lifted during transfer. However, the stated problem of matching the drive motor is not present when two mutually opposing scissors-like supports are disposed on the support frame and the drive motors connected thereto operate similarly. The auxiliary support described as an example comprises two mutually oppositely disposed scissors-like supports each with two rollers, of which one of the supports engages the top of the roll and the other the bottom.

According to FIG. 2 the two scissors bearings are connected together by means of a mechanical coupling drive. This coupling drive comprises a connecting rod 32 which couples together the free ends of two lever arms 33 and 34 in a pivotal manner. The lower lever arm 33 is in rigid connection with the support beam 26 of the lower left-hand support roller 25. The upper lever arm 34 is attached to the support arm of the upper right-hand support roller 25. A similar coupling drive, including a lower lever arm in rigid connection with the support beam of the lower right-hand support roller 25 and an upper lever arm in rigid connection with the support arm of the upper left-hand support roller 25, is provided. With such a mechanical coupling a common control drive for all four support rollers is produced the equidistance of which from an imaginary geometrical roll axis is ensured. This roll axis is fixed in relation to the support frame 29 and coincides co-axially with the axis of a roll 4 or 5 independently of the diameter thereof, as soon as the four support rollers rest on the roll surface. A similarly acting coupling of the two scissors-like supports may be obtained by hydraulic or pneumatic coupling members by way of the two pusher motors 31. Also the use of equivalent electrical coupling members is possible in the given context and, similarly to that of hydraulic or pneumatic coupling members, is advantageous in particular when only one single carrying scissors bearing is to be coupled to an oppositely disposed support roller and the position of the scissors-like support is to be controlled dependently on the position of the oppositely disposed roller.In this last mentioned case the auxiliary support comprises a group of three rollers the equidistance of which from an imaginary geometrical roll axis is ensured, in spite of the variability of the spacing, by the coupling of the roller supports.

The auxiliary support 2 may comprise a plurality of equal groups of support rollers 25 which are then disposed one adjacent the other along a roll. The number of groups is a function of the length of the support rollers, the length of the rolls and the carrying capacity of the support beams.

In the constructional example described and illustrated the geometric roll axis of the main support 1 determined by the mandrels 13 and the geometrical roll axis of the auxiliary support 2 determined by the entire control drive of the two scissors bearings have the same spacing from the base frame 17 and from the tracks 18, respectively. These tracks extend in such a manner that in one position of the auxiliary support on its path the geometrical roll axis thereof coincides co-axially with that of the main support. This position is also fixed as the forward end position of the auxiliary support.

As soon as the roll 4 has completely expired, the support beams 26 with the support rollers 25 located thereon are pivoted into a position which is illustrated in FIG. 2. In this operational state the auxiliary support 2 can be moved on the base frame 17 by means of the tracks 18 to an interchange roll 5 which is still located between the mandrels 13 of the main support 1. FIG. 2 illustrates in dash-dotted lines and in full lines two positions of the interchange roll 5 which engages in an open inlet of the support frame 29. Upon coincidence of the geometrical roll axes of the main support and the auxiliary support according to the illustration in FIG. 5, the drive motors 31 press the control sliders 30 in the direction of the interchange roll in such a manner that the support rollers 25 lie on the surface of the interchange roll and support the latter. The interchange roll 5, according to FIG. 5, had previously the magnitude of a replacement roll 3 drawn in broken lines. As soon as the mandrels 13 have been moved out of the interchange roll in the manner previously described in connection with FIGS. 1 and 4, the auxiliary support 2 can be guided back from the forward end position according to FIG. 5 into the rearward end position according to FIG. 1 again by means of the traction device 20 and a complete replacement roll can be inserted into the main support. As may be seen from a comparison of FIGS. 1 and 5, the change of the roll from the main support on to the auxiliary support can be effected without interruption of the operation, since the paper web 7 is guided and diverted by the lower left-hand support roller 25 and can run off without disturbance.

Figure 3:
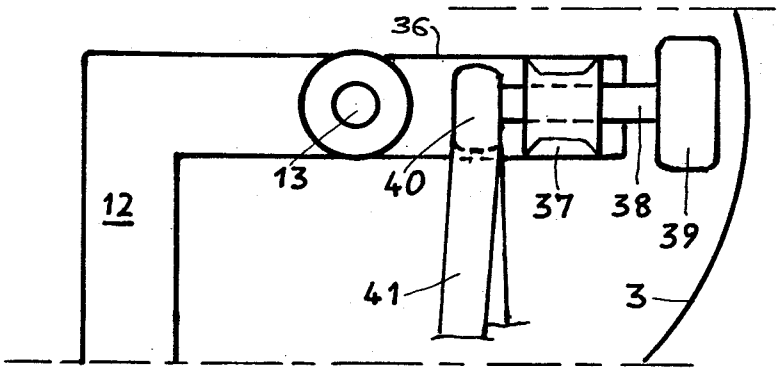
FIG. 3 is a diagrammatically shown section of the main support according to FIG. 1, on which additionally a driving mechanism for accelerating rotation of a replacement roll is disposed.

According to FIG. 3, a drive mechanism for accelerating rotation of a replacement roll 3 may be arranged at least at one of the support arms 12 of the main support 1. In this case the support arm 12 is provided with an extension 36 to which a shaft bearing 37 is attached. In this shaft bearing is located a rotatable shaft 38 which supports at one end of it ends a drive roller 39 and at its other end a belt pulley 40. A driving belt 41 connects the belt pulley under certain circumstances by way of a further gearing to a drive motor (not illustrated). Preferably that motor is employed as a driving motor for the mechanism according to FIG. 3, which also serves for drawing off the paper webs 6 and 7 by means of a drafting shaft (longitudinal shaft) in the region of the tube-making machine or under certain circumstances the roll support.

The shaft 38 lies in a radial plane with reference to the axis of the main support 1. Though a perfectly radial mounting of the shaft during the operation is advantageous, it is not essential. In any case, however, the drive roller must lie as resiliently as possible on the end face of the replacement roll 3 in such a manner that the drive roller is able to drive the roll for rotational movement about the roll axis. Pivoting and pressing means (not illustrated) preferably of pneumatic kind at the drive mechanism, according to FIG. 3, may ensure that the driver roller lies resiliently on the replacement roll and permits it to be swung out of the region of the roll, as soon as the latter does not require any more the particular drive or is to be transferred to the auxiliary support.

A brake device (not shown) may be provided engaging the roll in the auxiliary support 2 to maintain roll tension.

The illustrated and described embodiment of the roll support assembly according to the invention has the advantage over many other possible embodiments since it is constructed in a particularly simple manner.

I claim:

1. A roll support assembly for supporting webs wound in separate supply rolls and the ends of which are to be joined to produce a continuous web, comprising: a main support comprising two support arms and two mandrels, one of the mandrels mounted on each of the support arms, the mandrels adapted to support the axial ends of each newly loaded supply roll; an auxiliary support to which each supply roll may be transferred when partly expired to enable a further supply roll to be loaded on the main support, the auxiliary support comprising at least one group of rollers adapted to engage the peripheral surface of the supply roll and means for mounting the rollers in such a manner as to be movable by mutually equal amounts towards and away from a base frame connecting the main and the auxiliary supports; the axis of the supply roll and means on the auxiliary support to provide relative movement of the main and auxiliary supports on the base frame such that a partly expired roll may be simultaneously supported by both supports.

2. The roll support assembly as claimed in claim 1, in which the or each group of rollers comprises two rollers and wherein the mounting means comprises: support arms, each of the support arms rotatably mounting one of the support rollers, a control slider adapted to pivot the support arms about parallel or coaxial axes and control arms connecting the support arms to the slider.

3. The roll support assembly as claimed in claim 1, in which the auxiliary support comprises a total of four rollers which, during operation, are disposed symmetrically about the axis of a supply roll.

4. The support assembly as claimed in claim 3, in which the four rollers are arranged in two groups of two, the mounting means for each group comprising a pair of support arms, each of the support arms rotatably mounting one of the support rollers, a control slider adapted to pivot the support arms and control arms for connecting the support arms to the slider.

5. The roll support assembly as claimed in claim 1, further comprising a guide on the base frame for guiding the movement of the auxiliary support relative to the main support along a substantially rectilinear path with the axes of the supply rolls in the main and auxiliary supports remaining parallel.

6. The roll support assembly as claimed in claim 1, further comprising a drive mechanism mounted on one of the support arms for accelerating the rotation of a roll on the main support.

7. The roll support assembly as claimed in claim 6, in which the drive mechanism comprises a drive means, a shaft, a belt or chain connecting the drive means to the shaft and at least one drive roller operative to engage an axial end face of the roll and mounted on the shaft .

8. The roll support assembly as claimed in claim 3, in which the four rollers are arranged in two groups of two, the mounting means for the two groups of rollers comprising two pairs of support arms, each of the support arms rotatably mounting one of the support rollers, a control slider adapted to pivot the support arms, a pair of control arms connecting a pair of support arms to the slider and a mechanical coupling drive connecting the pair of support arms connected to the slider to the other pair of support arms.

* * * * *